US005980816A

United States Patent [19]

Suenaga et al.

[11] Patent Number: 5,980,816

[45] Date of Patent: Nov. 9, 1999

[54] METHOD AND APPARATUS FOR REMOVING DEPOSIT IN NON-FERROUS SMELTING FURNACE

[75] Inventors: Chikashi Suenaga; Manabu Tanaka; Yutaka Yasuda, all of Oita-ken; Kiyoharu Ito; Yasuto Katayama, both of Fukuoka-ken, all of Japan

[73] Assignee: Nippon Mining and Metals Co., Ltd., Tokyo, Japan

[21] Appl. No.: 08/960,838

[22] Filed: Oct. 30, 1997

[30] Foreign Application Priority Data

Nov. 5, 1996 [JP] Japan ..... 8-308794

[51] Int. Cl.[6] ..... C22B 15/00

[52] U.S. Cl. ..... 266/44; 266/135; 266/DIG. 1

[58] Field of Search ..... 266/135, DIG. 1, 266/44, 281

[56] References Cited

U.S. PATENT DOCUMENTS 3,960,546 6/1976 Rote et al. ..... 266/DIG. 1

FOREIGN PATENT DOCUMENTS 405086422 4/1993 Japan ..... 266/DIG. 1

OTHER PUBLICATIONS

Japanese Patent Abstract JP408121741A, May 1996.

Japanese Patent Abstract JP410140255A, May 1998.

*Primary Examiner*—Scott Kastler

*Attorney, Agent, or Firm*—Akin, Gump, Strauss, Hauer & Feld, L.L.P.

[57] ABSTRACT

A method of removing furnace deposit in a non-ferrous smelting furnace, comprising the steps of inserting a lance 2 provided with a spray nozzle 4 at the tip thereof from a furnace ceiling into a furnace; spraying a reducing agent from the spray nozzle 4 at the tip of the lance toward a molten deposit mainly comprising oxides adhering to a furnace wall surface of a non-ferrous smelting furnace by turning the lance within a prescribed angular range and vertically moving the lance within a prescribed range; reducing the molten deposit into a low-melting-point slag; causing the slag to flow; and discharging the slag together with furnace slag to outside the furnace.

7 Claims, 9 Drawing Sheets

METHOD AND APPARATUS FOR REMOVING DEPOSIT IN NON-FERROUS SMELTING FURNACE

BACKGROUND OF THE INVENTION

The present invention relates to a method of removing a molten deposit mainly comprising oxides generated near a waste gas exit of a non-ferrous smelting furnace, and an apparatus therefor, particularly adapted for use in a copper flash-smelting furnace.

FIG. 8 illustrates a schematic construction of a copper flash-smelting furnace 100. The flash-smelting furnace 100 comprises a reaction shaft 101, a settler 102, and an uptake103. Copper concentrate in the form of a dried fine powder and an oxygen-enriched air or a high-temperature blast are blown at a time into the reaction shaft 101. The copper concentrate and the oxygen-enriched air or hot blast are instantaneously subjected to an oxidation reaction. The copper concentrate melts under the effect of the reaction heat thereof, and in the settler 102, is separated into a mate 104 containing about 60% Cu and a slag (not shown) having a Cu grade of under 1%. The mate is further refined in a converter and a subsequent process into blister copper. The slag is sent to an electric furnace annexed to the flash-smelting furnace, in which, after recovery of part of Cu contained in the slag, the slag is granulated by means of sea water, and used as a material for cement.

Waste gas from the flash-smelting furnace having a temperature of about 1,300° C. and an $SO_2$ concentration within a range of from 10 to 40% is fed from an exit opening 105 of the uptake 103 to a waste-heat boiler 200 to cool waste gas and the sensible heat is recovered in the form of a high-pressure steam. Then, after dust is removed by an electrostatic dust precipitator, waste gas is sent to a sulfuric acid plant to recover $SO_2$ as sulfuric acid.

The flash-smelting furnace 100, in which oxidation reaction heat of concentrate can be effectively utilized, has a lower fuel consumption ratio as compared with the other processes, and permits supply of high-concentration $SO_2$ to the sulfuric acid plant, resulting in such advantages as a high recovery ratio of $SO_2$ and favorable merits in the aspect of environmental protection.

In the flash-smelting furnace, however, generation of peroxides is inevitable because fine powdery concentrate is oxidized during a very short residence time in the reaction shaft 101, and produced peroxides flow, as dust together with waste gas flow, from the settler 102 through the uptake 103 into the waste-heat boiler 200. Since peroxide have generally a high melting point, part thereof adheres to the settler 102 side walls or portions around the uptake 103 where temperature is relatively low as shown in FIG. 9, thus becoming a molten dust deposit commonly known as a wall accretion 106. If left unremoved, this molten dust deposit gradually grows and causes a clogging trouble in the uptake 103. Because dust is in semi-molten state, the molten dust deposit may flow on the wall surface and drops into the settler 102, thus causing operational troubles such as reduction of the furnace volume and slag hole clogging.

With a view to removing this molten dust deposit 106 which mainly comprises magnetite ($Fe_3O_4$), a high-grade Fe oxide, the present inventors found it effective to achieve a low-melting-point slag by the addition of a reducing agent, and developed a method of preventing molten dust deposit from growing by injecting granular coke as a reducing agent into the uptake section 103 by pneumatic transportation, and bringing the same into contact with the molten dust deposit on a waste gas flow. This method has already been in actual use (Japanese Patent Application Laid-Open No. H01-87, 728).

The granular coke blowing apparatus now in use is however dependent upon dispersion of a reducing agent (glanular coke) by waste gas flow in the furnace and contact thereof with molten dust deposit, and it is difficult to spray coke serving as the reducing agent over a wide range and certainly to a growing portion of the molten dust deposit. It is therefore impossible to prevent local growth of the molten dust deposit at the uptake ceiling or the top side wall, failing to achieve a complete resolution of the problems.

The present invention has therefore an object to provide a method and an apparatus for removing furnace deposit of a non-ferrous smelting furnace, which permits effective removal of a molten dust deposit over a wide range for an overall growing portion of molten dust deposit.

BRIEF SUMMARY OF THE INVENTION:

The foregoing object is achieved by means of the method and the apparatus for removing furnace deposit of a non-ferrous smelting furnace of the present invention. In summary, the present invention provides a method of removing furnace deposit in a non-ferrous smelting furnace, comprising the steps of inserting a lance provided with a spray nozzle at the tip thereof from a furnace ceiling into the furnace; spraying a reducing agent from the spray nozzle at the tip of said lance toward a molten deposit mainly comprising oxides adhering to a furnace wall surface of a non-ferrous smelting furnace by turning the lance within a prescribed angular range and vertically moving the lance within a prescribed range; reducing the molten deposit into a low-melting-point slag; causing the slag to flow; and discharging the slag together with furnace slag to outside the furnace.

According to an embodiment of the invention, the non-ferrous smelting furnace is a flash-smelting furnace for copper smelting, and it is possible to remove the molten deposit adhering to the inner wall of a settler section and an uptake section of the flash-smelting furnace. In another embodiment, the reducing agent is a coke breeze or a carbonaceous material powder, and $N_2$ is used as a pneumatic transporting medium. In further another embodiment, the quantity of coke breeze or carbonaceous material powder sprayed in the furnace is adjustable within a range of the ratio of maximum to minimum quantities of spray of 10:1 by changing the spray time of intermittent spray and the quantity of spray per unit spray time, and the range of circumferential spray is freely changeable within a range of from 180° to 360°.

The foregoing method of the invention is effectively carried out in an apparatus for removing furnace deposit in a non-ferrous smelting furnace comprising: a hollow lance capable of being inserted into a furnace through an opening provided in a ceiling of a non-ferrous smelting furnace; a pneumatic transportation apparatus for supplying a reducing agent toward the top of the lance; a spray nozzle connected to a tip of the lance; a vertically movable carriage; lifting driving means for vertically driving the carriage; and rotation-driving means for rotation-driving the lance around a lance axis; wherein, after inserting the lance into the furnace, the lance is rotated within a prescribed angular range by driving the lance with the lifting driving means and the rotation-driving means and moved vertically within a prescribed range; simultaneously, the reducing agent is supplied from the pneumatic transportation apparatus to the lance; and the reducing agent is ejected from the spray nozzle at the tip of the lance at a flow velocity of over a certain level so as to cause the reducing agent to reach a prescribed target position.

According to an embodiment of the apparatus of the present invention, the non-ferrous smelting furnace is a flash-smelting furnace for copper smelting, and the lance is inserted into the furnace through an opening with an opening/closing cover provided in a ceiling of the uptake section. Or, the reducing agent is a coke breeze or a carbonaceous material powder, and $N_2$ is used as a pneumatic transportation medium. In further another embodiment, the upper portion of the lance has a construction in which a first pipe engages with a second pipe; the first pipe is connected to the pneumatic transportation apparatus of the reducing agent; and the second pipe is connected to a carrier gas feeder for adjusting the flow velocity upon spraying.

DETAILED DESCRIPTION OF THE INVENTION:

Now, the method and the apparatus for removing furnace deposit of a non-ferrous smelting furnace of the present invention will be described below further in detail with reference to the drawings. In this embodiment, the method and the apparatus for removing furnace deposit will be described with reference to a flash-smelting furnace for copper smelting as a non-ferrous smelting furnace. The present invention is not however limited to a flash-smelting furnace for copper smelting, but is applicable to various non-ferrous smelting furnaces including an MI furnace, a blast furnace and a reverberatory furnace which has problems regarding other similar deposits.

Figure 1:
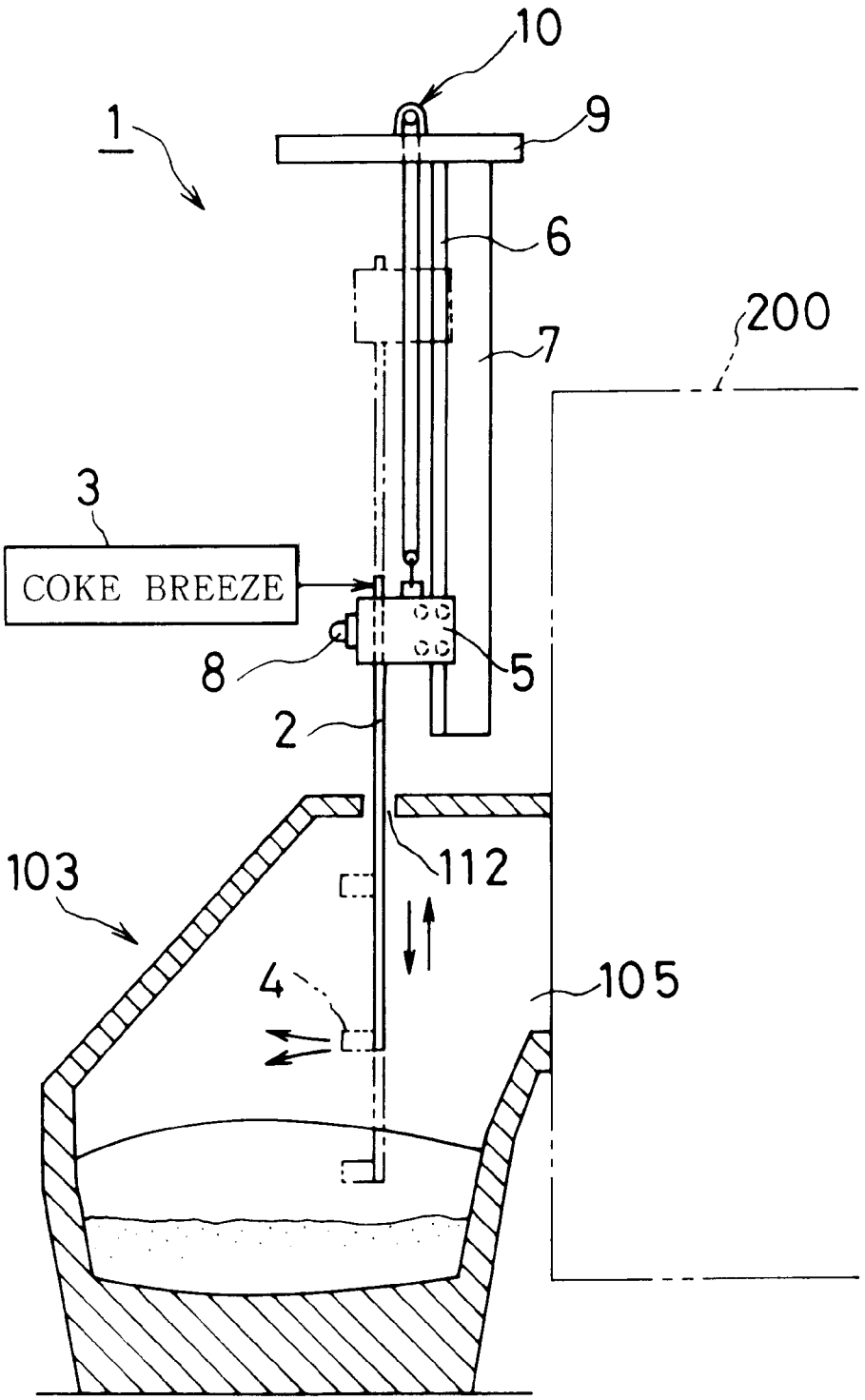
FIG. 1 is a schematic configurational side view of the apparatus for removing furnace deposit of a non-ferrous smelting furnace of the present invention, as attached to an uptake section of a flash-smelting furnace.
Figure 8:
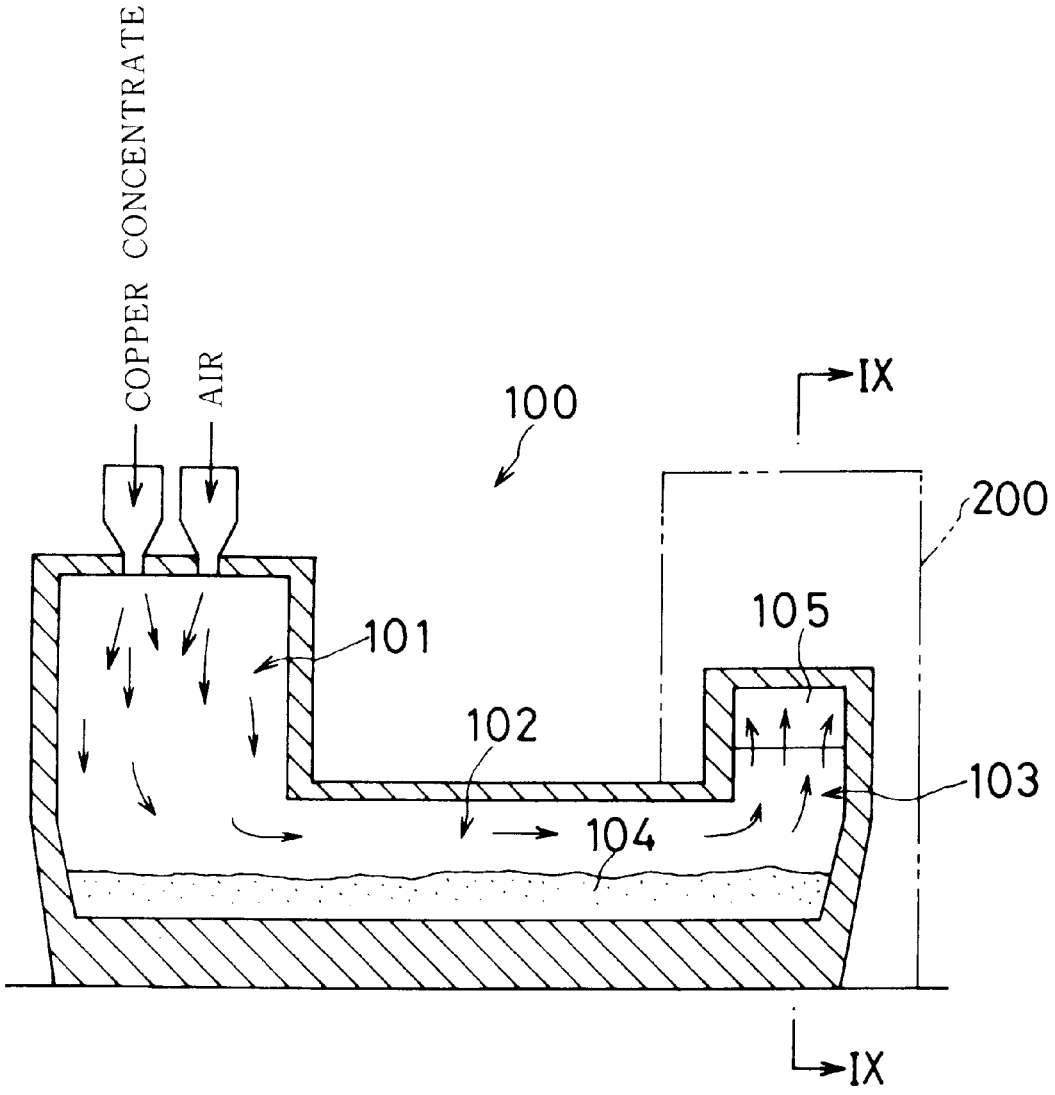
FIG. 8 is a sectional view illustrating a schematic configuration of a conventional flash-smelting furnace.
Figure 9:
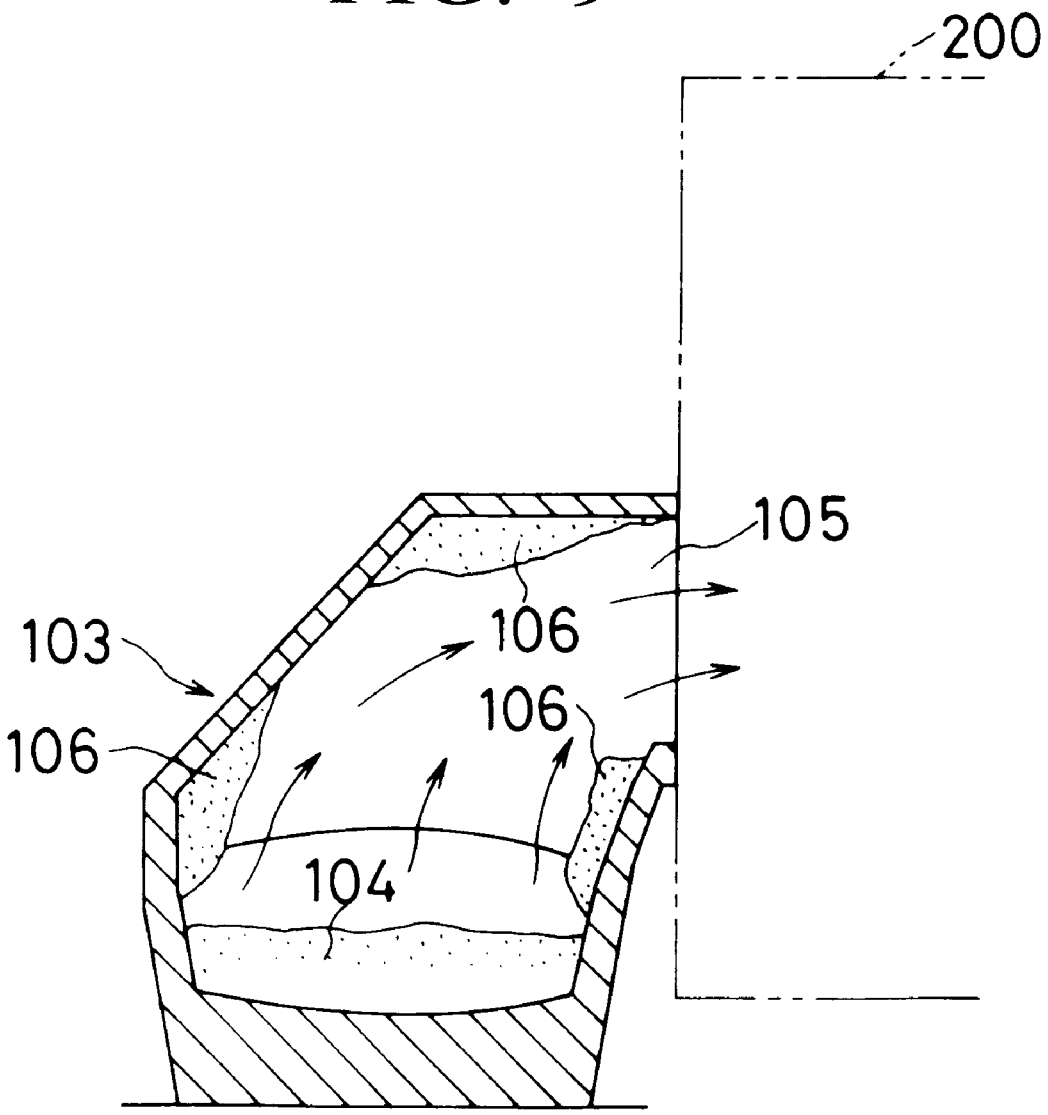
FIG. 9 is a sectional view of the uptake section of a flash-smelting furnace of FIG. 8 cut along the line IX—IX.

The flash-smelting furnace has a schematic configuration as described above in association with FIG. 8, and a detailed description is omitted here. FIG. 1 illustrates the apparatus 1 for removing furnace deposit having the configuration according to the invention, as attached to an uptake 103 of a flash-smelting furnace.

The furnace deposit removing apparatus 1 has a hollow lance 2 capable of being inserted into the uptake through an opening 112 provided on ceiling wall of the uptake 103 and having an opening/closing cover. The top end portion of the lance 2 is connected to a pneumatic transportation apparatus 3 of coke breeze. A nozzle 4 is attached to the tip portion of the lance, in a shape in which the lance center axis and the nozzle tip portion form an angle within a range of from 90° to 150°. This nozzle angle should be larger when a reducing agent is sprayed to a lower part of the furnace inner wall, and should be smaller when the reducing agent is sprayed mainly to an upper part.

Figure 2:
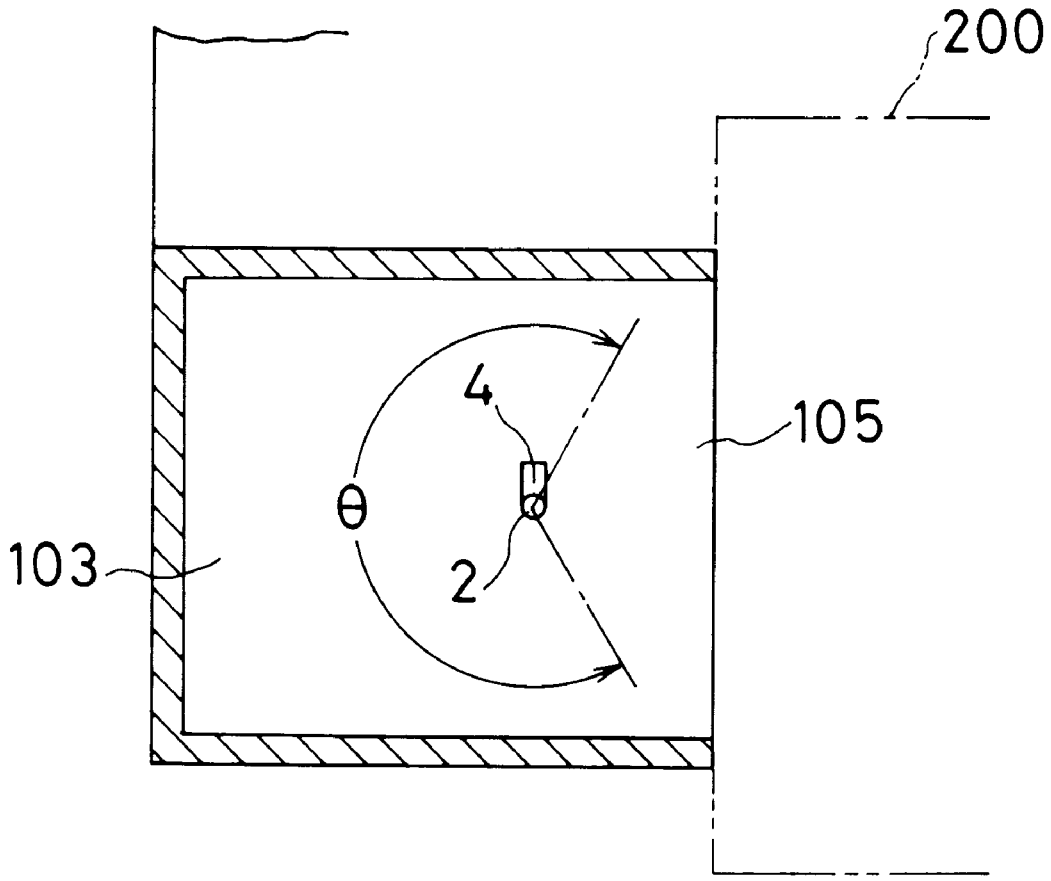
FIG. 2 is a plan sectional view of an uptake section illustrating the turning range of a nozzle.
Figure 3A:
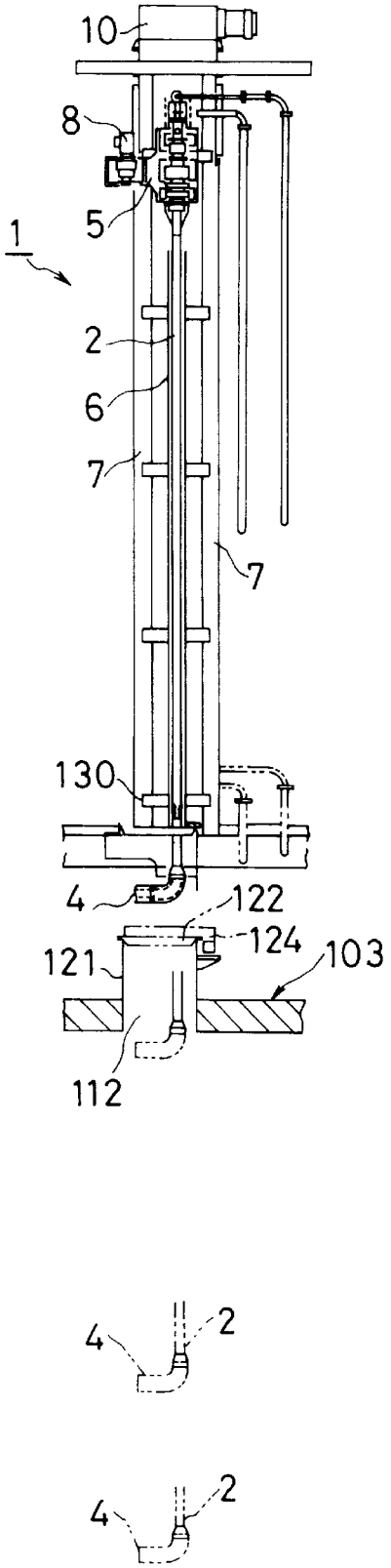
FIGS. 3(A) and 3(B) are a front view and a side view, respectively, of the apparatus for removing furnace deposit of a non-ferrous smelting furnace of the invention.
Figure 3B:
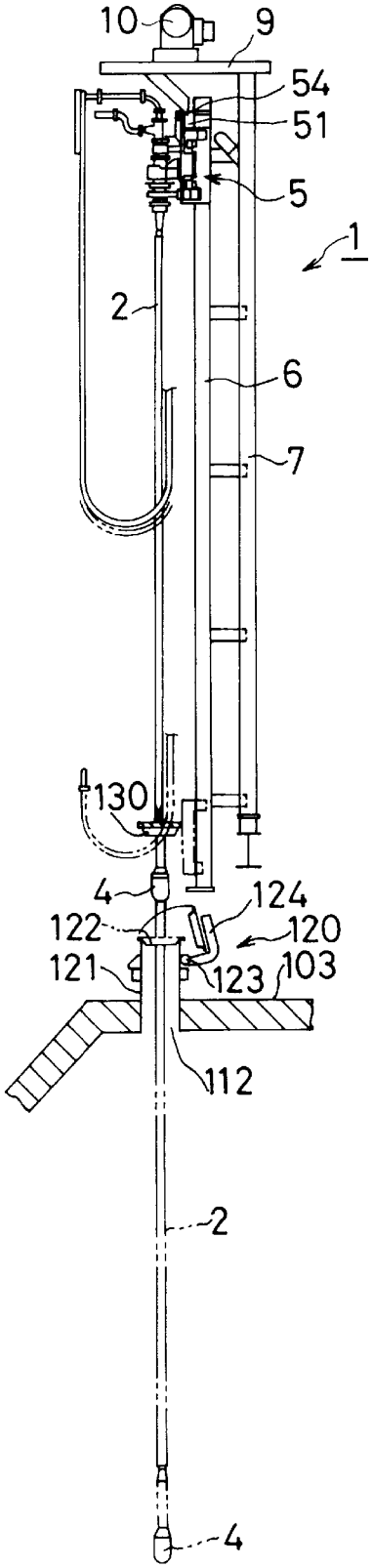

According to the present invention, the lance 2 is vertically movable within the uptake 103 of the flash-smelting furnace, and as shown in FIG. 2, rotatable within a prescribed angular range (θ). In this embodiment, therefore, as will be understood from FIGS. 3(A) and 3(B), the lance 2 is held by a carriage 5, and this carriage is vertically movable along rail means 6 extending vertically. The rail means 6 is attached to a base 7 extending vertically, and the base 7 is secured, for example, to a strut of the uptake 103. Furthermore, the lance 2 is rotatable around an axial line thereof by lance rotation-driving means 8 provided on the carriage 5.

Figure 4:
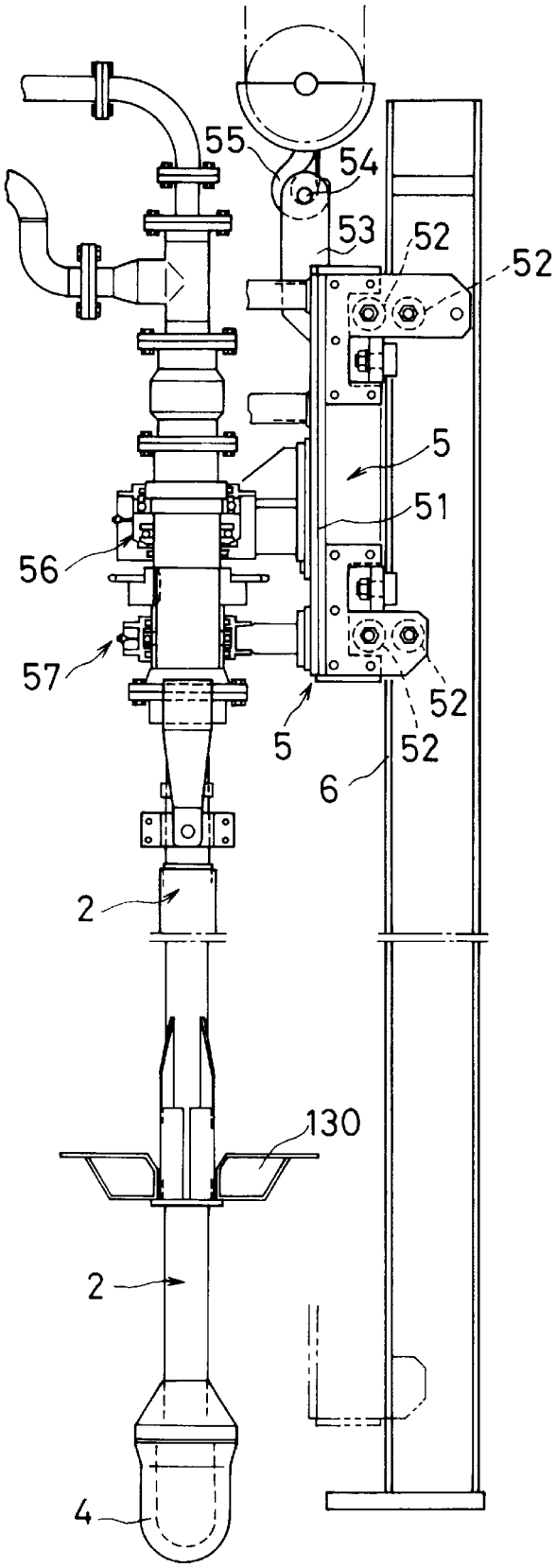
FIG. 4 is a detailed side view of the apparatus for removing furnace deposit of a non-ferrous smelting furnace of the invention.
Figure 5:
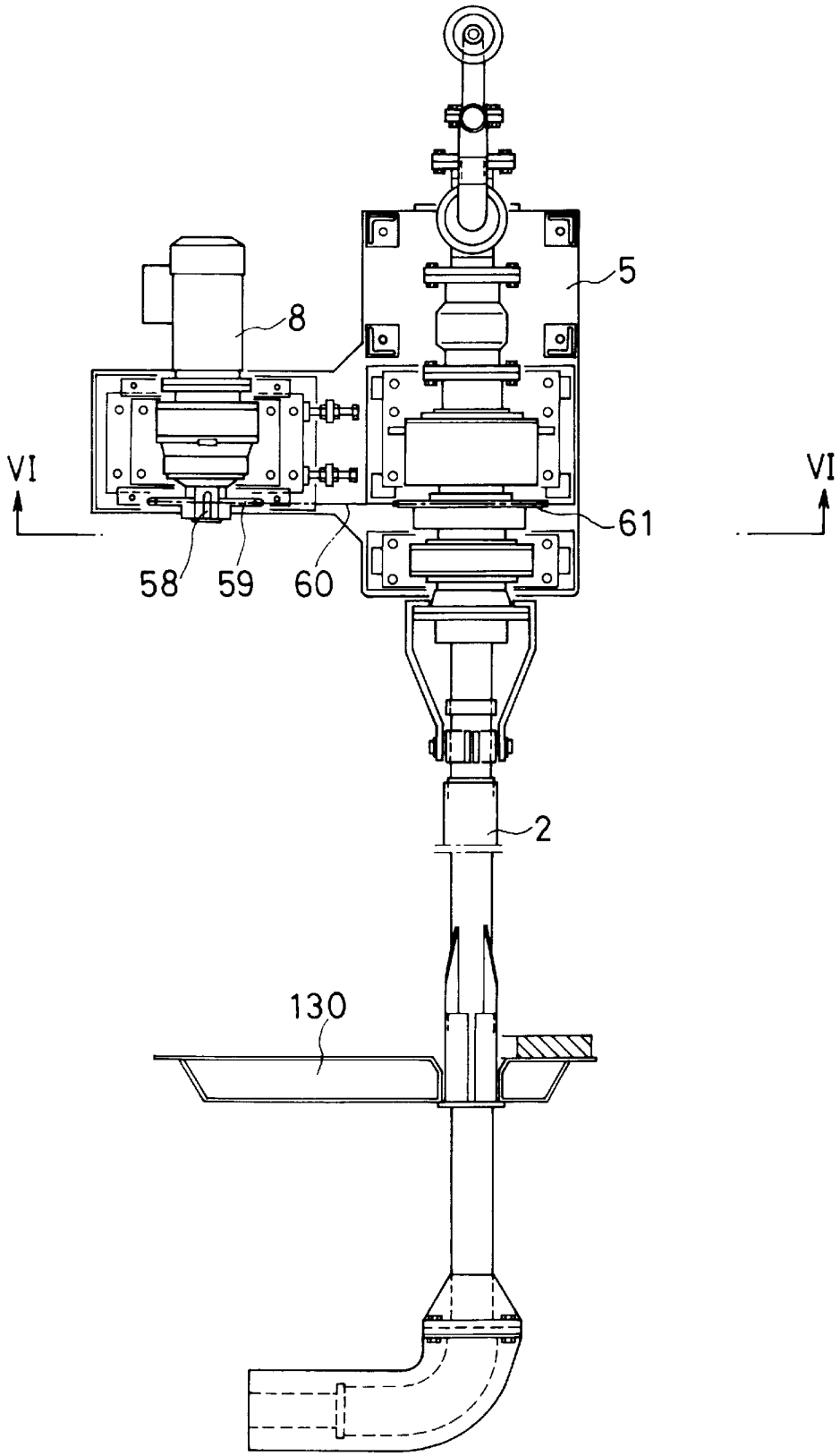
FIG. 5 is a detailed front view of the apparatus for removing furnace deposit of a non-ferrous smelting furnace of the invention.
Figure 6:
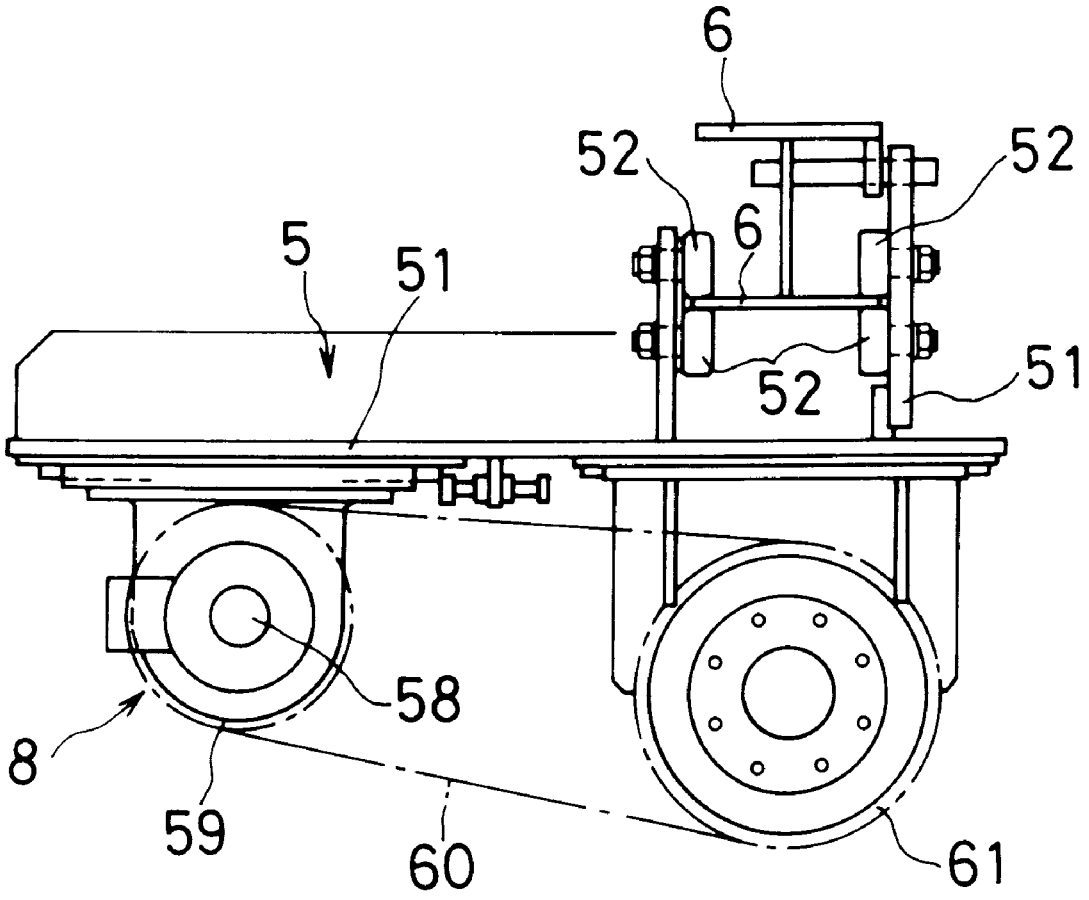
FIG. 6 is a sectional view of FIG. 5 cut along the line VI—VI.

Referring further to FIGS. 4 to 6, an I steel beam is used for the rail means 6 in this embodiment, as is most clearly represented in FIG. 6. The carriage 5 is provided with a support stand 51 to which the lance 2 is to be attached, and a pair of rollers 52 and 52 holding the rail means 6 from right and left, arranged at each of the upper and the lower ends of the support stand 51. In addition, at the top end of the support stand 51, there are provided a pair of arms 53 projecting upward, and a support rod 54 connecting these arms 53. A hook 55 engages with this support rod 54. The hook 55 is driven by lifting driving means 10 such as a winch installed in a horizontal support 9 arranged above the base 7 (FIG. 3). By driving the winch 10, the carriage 5, i.e., the lance, is moved vertically along the rail means 6. In this embodiment, the foregoing winch rotates at variable revolutions, and the lifting and descending speeds are changeable within a range of from 1 to 10 m/min.

The lance 2 is rotatably held by the carriage 5 via bearing means 56 and 57, as shown in FIGS. 3 and 4.

Further, lance rotation driving means 8, which is an electric motor in this embodiment, is provided on the foregoing carriage 5, as is clearly represented in FIGS. 5 and 6. The electric motor 8 rotation-drives the lance 2 via a chain 60 stretched between a wheel provided on an output shaft 58 thereof and another wheel 61 fixed to the lance 2. The rotation-driving means 8 has a limit switch for limiting the range of rotation to permit setting of any arbitrary range of rotation by adjusting the position thereof. In this embodiment, revolutions of the electric motor for rotation is variable to make the rotation velocity variable within a range of from 1 to 8 rpm.

The lance 2 should preferably retreat to outside the furnace when it is not in use. In this embodiment, therefore, as shown in FIG. 3, an oval-shaped lance inserting opening 112 having a size allowing insertion/removal of the tip nozzle of the lance 2 is provided in a ceiling wall of the uptake 103. When the lance is in standby outside the uptake103, this opening 112 should be closed to prevent ejection of waste gas and ingression of free air. An opening/closing means 120 is therefore arranged on this opening 112.

More specifically, the opening 112 is in a state in which a cylindrical member 121 is inserted into a hole passing through the ceiling wall made of a refractory material, and the upper end opening of the cylindrical member 121 is closed by a cover member 122. This cover member 122 is supported by a rocking arm 124 attached rockably through a shaft 123 to the cylindrical member 121, so that the shaft 123, when rotated by an air cylinder (not shown), causes the rocking arm 124 to operate to close or open the upper end opening of the cylindrical member 121.

As will be understood by referring to FIGS. 3 to 5, a sealing cover 130 passes through the lance 2. This sealing cover 130 has the same shape and size as those of the cover member 122 of the foregoing opening/closing means 120 of the opening, having a throughhole arranged therein for sliding of the lance 2. The sealing cover 130 is suspended by a support stopper provided near the lower end of the lance 2. When the lance 2 is inserted into the uptake from the upper end opening of the cylindrical member 121 by opening the cover member 122 of the opening/closing means 120 of the opening, the sealing cover 130 goes down, together with the lance 2 to engage with the upper end opening of the cylindrical member 121, serving to close the upper end opening of the cylindrical member 121 during insertion of the lance 2 into the furnace.

Figure 7:
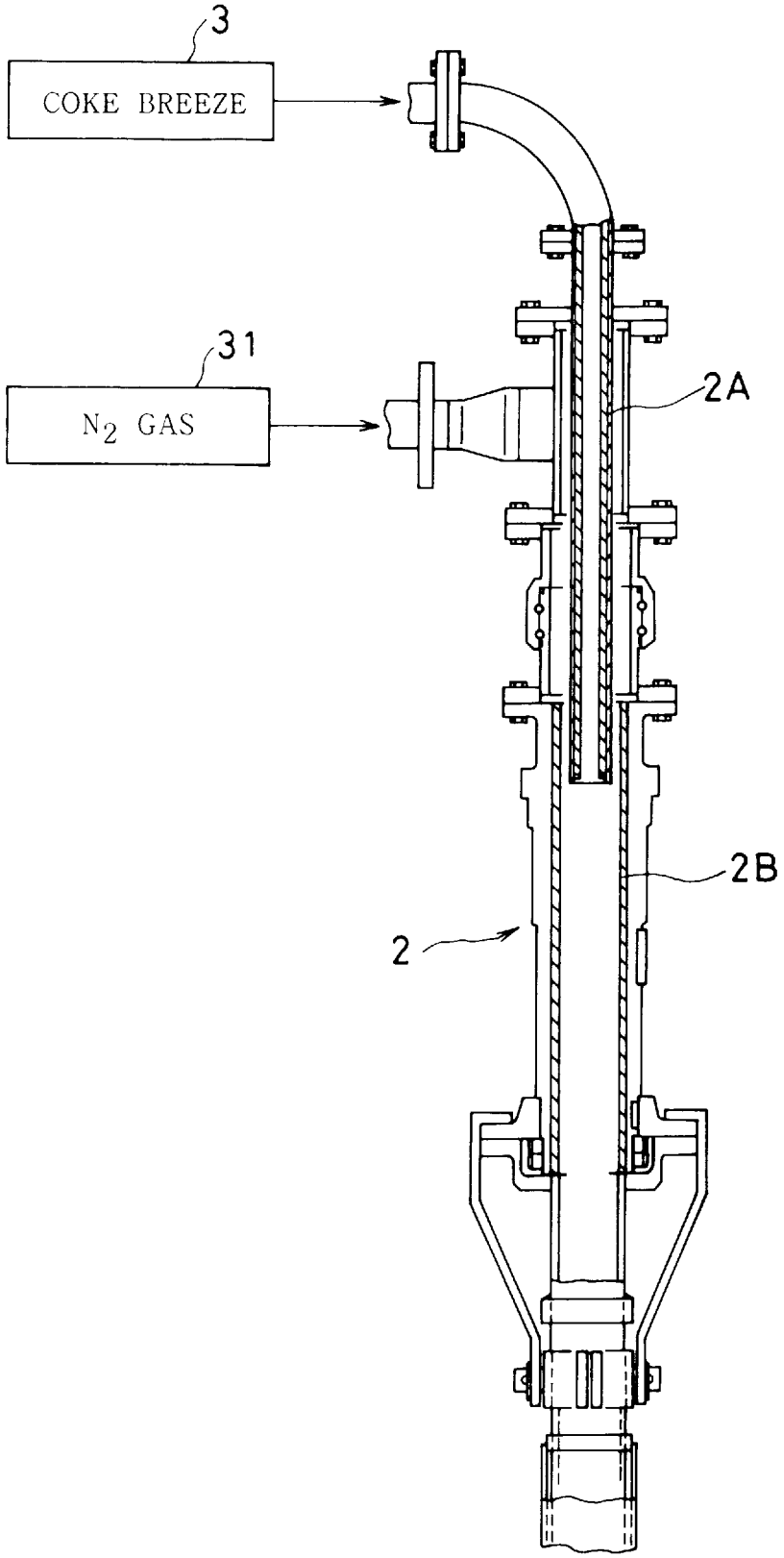
FIG. 7 is a side sectional view of the apparatus for removing furnace deposit of a non-ferrous smelting furnace of the invention, illustrating an upper portion of a lance.

According to this embodiment, the upper end portion of the lance 2 has a construction such that, as shown in FIG. 7, a first pipe 2A and a second pipe 2B engage with each other: the first pipe 2A is connected to the pneumatic transportation apparatus 3 of reducing agent, and the second pipe 2B is connected to a carrier gas feeder 31 for adjusting the flow velocity upon spraying. In this embodiment, therefore, the coke breeze is supplied by pneumatic transportation with $N_2$ as the transportation medium to the first pipe 2A, and $N_2$ gas for adjusting the flow velocity upon spraying is supplied to the second pipe 2B. These gases are mixed in a mixing chamber arranged therebelow and ejected from a nozzle 4 at the lower end of the lance in a prescribed quantity and at a velocity sufficient to cause the coke breeze to reach the uptake inner wall.

In this embodiment, an apparatus comprising a combination of a pressurized hopper and a table feeder is used as the pneumatic transportation apparatus of coke breeze serving as the reducing agent, with $N_2$ gas as the transportation medium. As the pneumatic transportation apparatus, however, any apparatus of any configuration may be adopted so far as it can stably supply coke breeze by pneumatic transportation in a quantity of about 50 to 600 kg/h to the leading end of the furnace deposit removing apparatus, with $N_2$ as the transportation medium, within a range of solid/gas ratio of from 0.5 to 10 kg/Nm$^3$.

$N_2$ which is an inert gas is used as the pneumatic transportation medium and the accelerating gas during spraying in this embodiment. The reason is that the principle of the invention is to reduce the molten dust deposit comprising oxides into a low-melting-point slag through contact with the solid reducing agent, and when using a gas containing oxygen such as air as the pneumatic transportation medium and the accelerating gas upon spraying, the solid reducing agent is oxidized and burned before reaching the mass to be dissolved, thus making it impossible to obtain a prescribed reducing and dissolving effect.

In this embodiment, furthermore, the pneumatically transported coke breeze and $N_2$ gas for acceleration upon spraying are mixed at the upper end of the lance. The coke ejected from the tip of the nozzle must reach the furnace inner wall at a distance of more than 1.5 m in the midst of a waste gas flow rising at a flow velocity of from 2 to 5 m/sec within the uptake, and a flow velocity of coke pneumatic flow of higher than 100 m/sec must be maintained at the nozzle tip. When conducting pneumatic transportation of coke breeze at this flow velocity, however, reduction of the service life is anticipated because of a wear of the end of the pneumatic transportation piping. In this embodiment, therefore, a construction to inhibit the flow velocity in the pneumatic transportation piping is adopted by separating the pneumatic transportation system of coke breeze from the accelerating carrier gas system.

Now, the following description will cover the method of removing molten dust deposit adhering to the uptake section inner wall of a flash-smelting furnace by the use of the furnace deposit removing apparatus having the configuration as described above. According to the result of measurement carried out by the present inventors, the waste gas of the flash-smelting furnace used in this embodiment has a temperature of about 1,280° C., an $SO_2$ concentration in waste gas of about 35%, and an $O_2$ concentration of under 1%. The molten deposit adhering to the uptake section is considered to have a chemical composition comprising 60% $Fe_3O_4$, 10% $2FeO.SiO_2$, 10% $Cu_2S$, 10% $Cu_2O$ and the balance other components.

When operating the furnace deposit removing apparatus 1, the steps comprise operating the air cylinder driving the rocking arm 124 of the cover opening/closing means 120 to move the cover member 122, and opening the lance inserting opening 112. Then, the winch 10 serving as the lifting-driving means of the lance 2 is driven to move down the carriage 5. As a result, the lance 2 goes down along the rail means 6 together with the carriage 5.

The lance 2 is inserted through the lance inserting opening 112 into the uptake. On the other hand, along with the descent of the lance 2, the sealing cover 130 is caused to go down to the upper end opening of the opening cylinder member 121 and engage with the opening to close it. Thereafter, the lance travels and rotates in a state in which the lance passes through the opening of the sealing cover 131.

The lance goes down and once stops in a state in which the nozzle tip reaches a position of 1 m from the uptake ceiling wall. Then, the coke breeze pneumatic transportation apparatus 3 and the accelerating gas feeder 31 operate, and coke breeze pneumatic flow and accelerating gas are supplied to the first pipe 2A and the second pipe 2B of the lance 2. Coke breeze is thus ejected from the spray nozzle 4 at the lower end of the lance into the uptake. Subsequently, lance rotation and moving up/down are performed while continuously conducting ejection.

When continuously ejecting coke breeze while rotating the lance by 360°, however, the nozzle tip tends to be directed toward the waste-heat boiler opening 105 and the ejected coke breeze splashes to the waste-heat boiler. In this case, not only the ejected coke does not serve to remove the molten dust deposit as the reducing agent, but also may be burned within the waste-heat boiler and may cause an increase in the gas temperature in the boiler.

In this embodiment, therefore, control is performed to change the rotation angle (θ) in response to the position of descent of the lance 2. More specifically, during the period in which the lance tip travels from the coke breeze ejection starting position to reach the lower end position of the waste-heat boiler opening 105, the rotation range of the lance is limited within about 240° within which the nozzle tip does not directly face the waste-heat boiler opening, and the lance is caused to go down while reversing the direction of rotation at the limit position. Thereafter, the rotation angle is changed to 360° at the moment when the lance nozzle tip position passes by the lower end of the waste-heat boiler opening 105. The coke/gas flow is ejected while continuously rotating the lance, and the lance goes down further. At the point when the lance reaches the lower limit position of descent thereof, the rotating direction is reversed by 360°, and the lance starts going up while continuously ejecting the coke/gas flow. The rotation range is limited again to about 240° at the moment when the nozzle tip position of the rising lance passes by the lower end of the waste-heat boiler opening 105, and the lance is raised while reversing the rotating direction at the position where the limit of rotating range is reached. The lance is still caused to go up, and at the moment when the lance tip position returns to the coke breeze ejection starting position, ejection is discontinued, and the lance is drawn up to outside the furnace.

The furnace deposit removing apparatus of the invention is basically operated in a batch manner. When a unit process ranging from the insertion of the lance 2 into the furnace to spray of coke breeze comes to an end, the apparatus enters a standby process, and after the lapse of a certain period of time, the process starts again the cycle of insertion into the furnace and spraying.

A smaller particle size of coke breeze results in a smaller inertia: even by increasing the flow velocity upon ejection, the coke would be entangled by the waste gas flow before reaching the furnace wall and probability of not reaching the furnace wall is high. In this embodiment, therefore, a coke breeze particle size of about 2 mm is adopted. However, because the particle size distribution contains those under 5 mm, the flow rate of the blown accelerating gas is changeable so as to ensure an optimum ejection rate in response to the particle size composition.

When conducting removal and growth prevention of molten dust deposit by the use of the furnace deposit removing apparatus of the invention, various values of coke breeze consumption, rotation speed of the lance 2, and moving up/down speed thereof can be set. This is described below by means of an example carried out by the application of the invention.

In this example, for the purpose of ensuring a satisfactory service life of the lance 2, operation was carried out in accordance with a policy of keeping the shortest possible furnace staying time required for lance vertical travel and coke spraying per unit process. A lance moving up/down speed of 6 m/min was adopted, with a rotation speed of 8 rpm, the maximum level. The quantity of ejected coke breeze was set to 600 kg/h per unit time of ejection, and the furnace staying time of the lance was 2.5 minutes per process. The coke breeze consumption was set by adjusting the standby time to shorten intervals of the spraying process. Initially, eight cycles of coke spraying were carried out per hour with a standby time of five minutes, with a coke consumption of 160 kg/h.

After the operation for an hour under these conditions, operation of the flash-smelting furnace for copper smelting was discontinued for a while, and the status of removal of molten dust deposit was observed through the lance insertion opening 112 of the uptake ceiling. The surface layer of dust adhering to the side wall was melted into liquid which dropped along the furnace wall. The molten state was very remarkable such that changes in the composition of slag discharged from the furnace was feared. The standby time was therefore extended to ten minutes and the operation was continued. Similarly, operation of the flash-smelting furnace was discontinued for a short period of time at a frequency of once a day to continuously observe the status of removal of dust. By continuing operation in this manner for three days, the thickness of the molten dust deposit adhering to the inner wall in a thickness of about 50 cm was reduced to about 10 cm. Thereafter, the standby time was extended to about 30 minutes with a coke consumption of 40 kg/h with a view to maintain a molten dust layer of a thickness of about 10 cm to protect the furnace wall.

Operation of the furnace deposit removing apparatus of the invention not only exerts a remarkable effect on removal of molten dust deposit, but also converts molten dust into slag which is discharged to outside the furnace in mixture with slag produced in the flash-smelting furnace for copper smelting. It was therefore possible to obtain an effect of preventing a slag hole clogging trouble or a bottom-up trouble in the flash-smelting furnace, which had so far been caused by molten dust deposit.

According to the method and apparatus for removing furnace deposit in a non-ferrous smelting furnace of the invention, as described above, the steps comprise inserting a lance provided with a spray nozzle at the tip thereof from a furnace ceiling into a furnace; spraying a reducing agent from the spray nozzle at the tip of the lance toward a molten deposit mainly comprising oxides adhering to a furnace wall surface of a non-ferrous smelting furnace by turning the lance within a prescribed angular range and vertically moving the lance within a prescribed range; reducing the molten deposit into a low-melting-point slag; causing the slag to flow; and discharging the slag together with furnace slag to outside the furnace. It is therefore possible to effectively remove molten dust deposit adhering to an uptake and a settler of a flash-smelting furnace for copper smelting, for example, and to control the quantity of deposit thereof.

We claim:

1. A method of removing furnace deposit in a non-ferrous smelting furnace, comprising the steps of inserting a lance provided with a spray nozzle at a tip thereof from a furnace ceiling into a furnace; spraying a reducing agent from the spray nozzle at the tip of said lance toward a molten deposit mainly comprising oxides adhering to a furnace wall surface of a non-ferrous smelting furnace by turning said lance within a prescribed angular range and vertically moving said lance within a prescribed range; reducing said molten deposit into a low-melting-point slag; causing said slag to flow; and discharging said slag together with furnace slag to outside the furnace.

2. The method of removing furnace deposit in a non-ferrous smelting furnace according to claim 1, wherein said non-ferrous smelting furnace is a flash-smelting furnace for copper smelting, and said method is to remove the molten deposit adhering to the inner wall of a settler section and an uptake section of said flash-smelting furnace.

3. The method of removing furnace deposit in a non-ferrous smelting furnace according to claim 2, wherein said reducing agent is a coke breeze or a carbonaceous material powder, and $N_2$ is used as a pneumatic transporting medium.

4. The method of removing furnace deposit in a non-ferrous smelting furnace according to claim 3, wherein the quantity of said coke breeze or said carbonaceous material powder sprayed in the furnace is adjustable within a range of the ratio of maximum to minimum quantities of spray of 10:1 by changing the spray time of intermittent spray and the quantity of spray per unit spray time, and the range of circumferential spray is freely changeable within a range of from 180° to 360°.

5. An apparatus for removing furnace deposit in a non-ferrous smelting furnace comprising: a hollow lance capable of being inserted into a furnace through an opening provided in a ceiling of a non-ferrous smelting furnace; a pneumatic transportation apparatus for supplying a reducing agent toward the top of said lance; a spray nozzle connected to a tip of said lance; a vertically movable carriage; lifting driving means for vertically driving said carriage; and rotation-driving means for rotation-driving said lance around a lance axis; wherein, after inserting said lance into said furnace, said lance is rotated within a prescribed angular range by driving said lance with said lifting driving means and said rotation-driving means and moved vertically within a prescribed range; simultaneously, the reducing agent is supplied from said pneumatic transportation apparatus to said lance; and the reducing agent is ejected from said spray nozzle at the tip of said lance at a flow velocity of over a certain level so as to cause the reducing agent to reach a prescribed target position.

6. The apparatus for removing furnace deposit in a non-ferrous smelting furnace according to claim 5, wherein said non-ferrous smelting furnace is a flash-smelting furnace having an opening and being adapted for copper smelting, said lance being insertable into the flash-smelting furnace through said opening, said flash-smelting furnace having an opening/closing cover disposed along a ceiling of said uptake section and being capable of closing said opening.

7. The apparatus for removing furnace deposit in a non-ferrous smelting furnace according to claim 6, wherein the upper portion of said lance has a construction in which a first pipe engages with a second pipe; the first pipe is connected to the pneumatic transportation apparatus of the reducing agent; and the second pipe is connected to a carrier gas feeder for adjusting the flow velocity upon spraying.

* * * * *